United States Patent [19]

Rumage et al.

[11] 4,397,374

[45] Aug. 9, 1983

[54] AUTO MECHANIC'S BODY SUPPORT

[76] Inventors: Donald V. Rumage, 2700 Mount Pleasant St.; Terry L. Biarnesen, 4720 N. Main St., both of Racine, Wis. 53402

[21] Appl. No.: 337,956

[22] Filed: Jan. 8, 1982

[51] Int. Cl.[3] ..... B25H 5/00

[52] U.S. Cl. ..... 182/129; 182/131; 182/132; 280/32.5

[58] Field of Search ..... 182/17, 116, 129; 129/130–132; 280/32.5, 32.6; 108/144

[56] References Cited

U.S. PATENT DOCUMENTS

| | | | |
|---|---|---|---|
| 2,701,168 | 2/1955 | Schemers | 182/116 |
| 2,798,652 | 7/1957 | Easton | 182/17 |
| 2,872,252 | 2/1959 | Konkle | 108/144 |
| 2,957,541 | 10/1960 | Everest | 182/115 |
| 2,969,123 | 1/1961 | Jamerson | 182/116 |
| 2,970,668 | 2/1961 | Snyder | 182/116 |
| 3,504,643 | 4/1970 | Burst | 108/144 |
| 3,976,155 | 8/1976 | Esch | 280/32.5 |
| 4,072,209 | 2/1978 | Bolis | 182/116 |

*Primary Examiner*—Reinaldo P. Machado
*Attorney, Agent, or Firm*—Arthur J. Hansmann

[57] ABSTRACT

An automobile mechanic's body support including a T-shaped mobile frame and rectangular tube members supported thereon. The support includes a platform for the mechanic to stand on and also a platform for the mechanic to lie on. Adjustments interconnect the platforms with the remainder of the support for adjusting both platforms for optimum positioning of the mechanic so that his body weight can be distributed between the standing platform and the chest-rest platform. Also, the stem of the T-shape permits the support to be positioned immediately adjacent the automobile front wheel for optimum accessibility to the engine compartment.

10 Claims, 2 Drawing Figures

37
18
36
34
13
17
19
24
29
16
23
12
21
W
11

18
36
37
38
12
S
28
39
41
17
16
27
33
26

34
13
32
29
24
21
31
11
10
19
14
23
22
F

AUTO MECHANIC'S BODY SUPPORT

This invention relates to a automobile mechanic's body support wherein the support provides a platform for both the feet and the torso of the mechanic so that he can work in the engine compartment.

BACKGROUND OF THE INVENTION

Automobile mechanics are well aware of the stresses and strains encountered while leaning over an automobile and performing work in the engine compartment. Currently there is nothing commonly available for relieving the stresses and strains by supporting the automobile mechanic's body while he is working on the engine or the like. Undoubtedly the reason that there is no mechanic's body support available on the market is that there has been no good and feasible answer to the problem and concern of supporting the mechanic's body while in the awkward position of leaning over the automobile for working in the engine compartment. However, U.S. Pat. Nos. 2,701,168 and 2,872,252 and 2,957,541 and 3,976,155 show supports or the like which are utilized by a person for performing various tasks in a position of leaning forward. Specifically, the first three patents disclose supports which are intended for use by an auto mechanic, and the last patent is for a support for use by a person laying floor tile. However, even these four disclosures fail to show an auto mechanic's support which has a standing platform and a torso-resting platform and with those two platforms being adjustable to accomodate either a different size person or for positioning a person at the most advantageous position according to the task being performed. More specifically, the disclosures in all four patents fail to show a device which permits the automobile mechanic to position the support either at the side or the front of the car where the engine compartment is forward on the automobile, all for permitting the mechanic to rest in a convenient position and to particularly approach the engine compartment on the support at the side of the automobile without the front wheel interfering with the positioning or the desirable stability and balance of the support.

Still further, the support of this invention differs from the prior art in that it provides a means whereby the mechanic can stand on the platform and still have freedom to lean forward onto a chest-resting platform and to do so without bumping into or being obstructed by any upstanding portion of the support itself, such as that portion which forms the juncture between the standing platform and the body rest platform. This particular point is in special contrast to U.S. Pat. No. 3,976,155 which shows a disclosure which applicants herein have found to be impractical with respect to the lack of clearance between the upright portion and the horizontal portion of the frame of the cart disclosed in that patent. That patent undoubtedly adequately discloses an arrangement for a person kneeling on its cart and laying floor tile, but it makes no reference whatsoever to an arrangement of the frame members related to a standing platform and a chest-resting platform and with the frame members having adequate support for the mechanic's body.

Still further, the present invention differs from the prior art in that it provides a chest rest platform which is adjustable to slide fore-and-aft for accomodating different sizes of auto mechanics or for positioning the mechanic in the most advantageous position for performing the work.

Also, the support of this invention differs from the prior art in that it provides both a standing platform and a chest-rest platform, with both platforms being adjustable, and with the frame of the support being arranged in a T-shape which provides for optimum stability throughout the positions of adjustment of the platforms and with the frame providing for maneuvering and positioning relative to the automobile front wheel so that it can be positioned in the desired position and extend virtually directly over the front wheel.

Other objects and advantages and distinctions over the prior art will become apparent upon reading the following description in light of the accompanying drawings.

DETAILED DESCRIPTION OF THE PREFERRED EMBODIMENT

Figure 2:
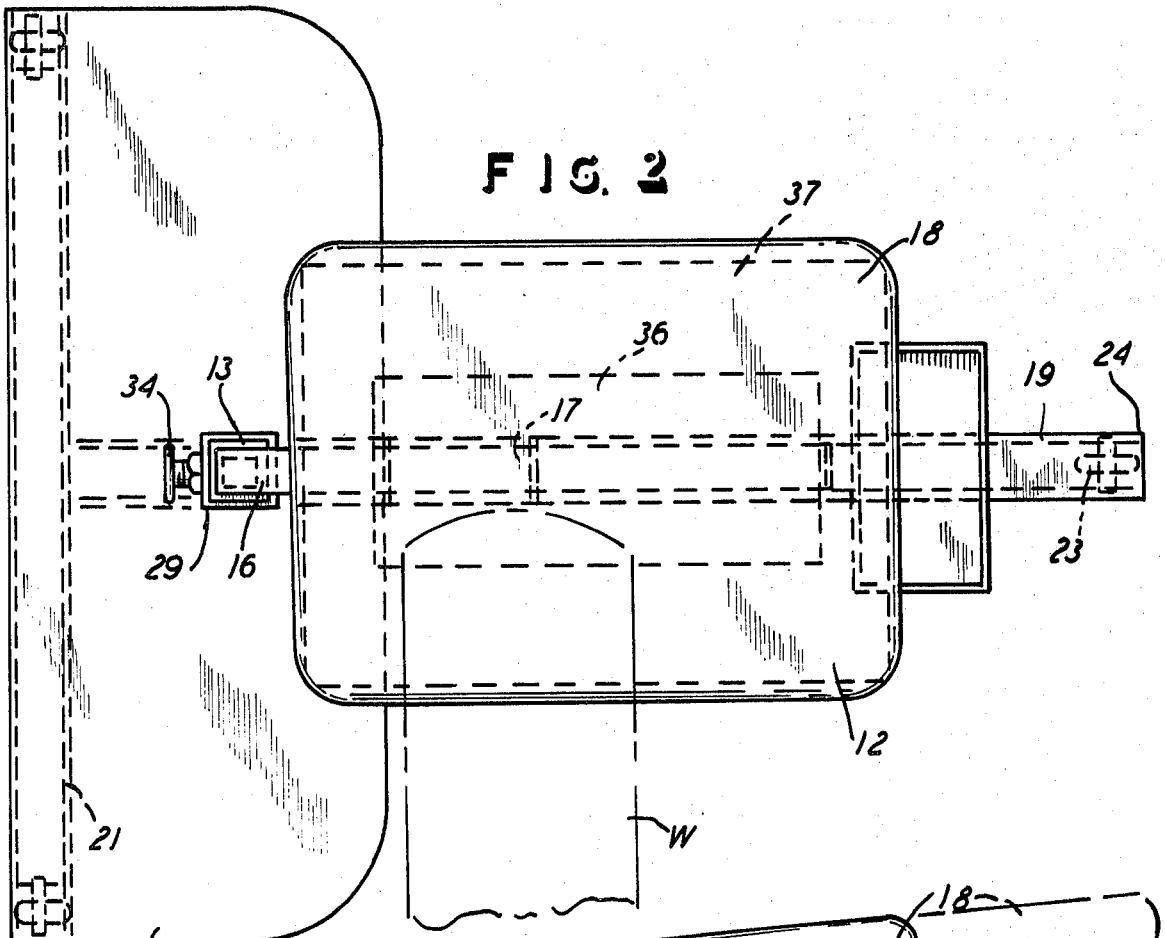
FIG. 2 is a top-plan view of FIG. 1, and with a portion of an automobile wheel shown relative thereto in dot-dash lines.

The support of this invention consists generally of a T-shaped frame 10, a standing platform 11, and a chest-rest platform 12. There is an upstanding frame member 13 which is suitably connected to the T-shaped frame 10, such as by the welding at 14, and the platform 12 has a tubular piece 16 which extends into telescoping position with the frame piece 13. Also, the platform 12 has a tubular sleeve 17 which slides on the piece 16 for adjusting the chest platform and particularly its cushion or pad 18 in the horizontal direction.

The frame 10 includes two rectangularly-shaped members 19 and 21, and they are joined together such as by means of welding at 22. In the plan view of FIG. 2, they form a T-shape and are both horizontally disposed and they present a juncture at the location of the weld 22 and they also have a wheel 23 at each of the free or extending ends of the T-shape frame 10, as shown. With that arrangement, the frame 10 is stable and mobile, and it can be positioned either at the front or the side of an automobile with the three wheels 23 on the floor F. When the support is positioned at the side of an automobile, such as shown in FIG. 2, it will readily negotiate the automobile front wheel designated W and shown in dot-dash lines in fragment. That is, the support can be positioned sufficiently close to the side of the automobile and the front wheels will not interfere with the positioning to the extent that the mechanic can position his torso on the chest-rest platform or pad 18 and thereby be positioned directly above the engine compartment in a desired position.

Figure 1:
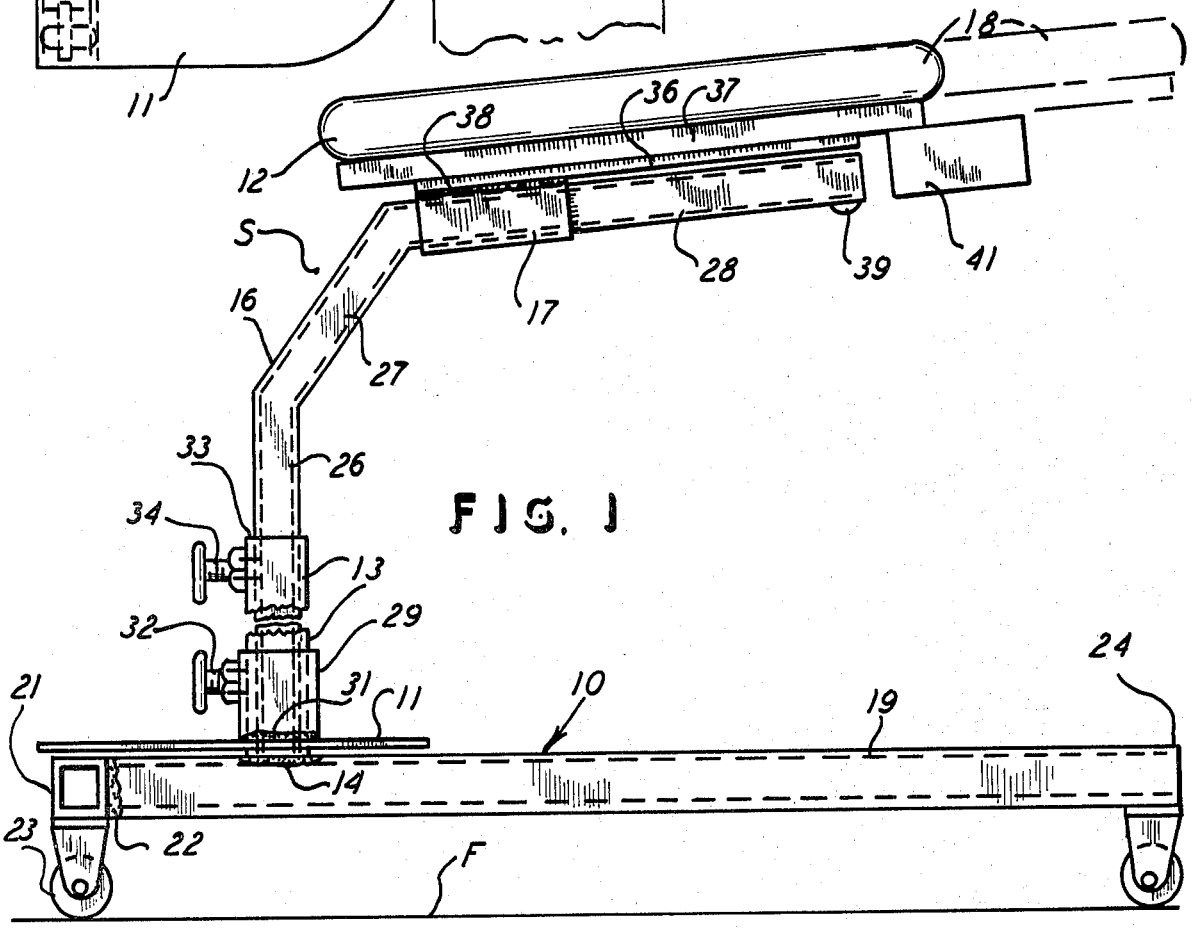
FIG. 1 is a side-elevational view of a preferred embodiment of this invention, with the intermediate portion thereof broken away.

The upper platform 12 is horizontally adjustable for positioning the mechanic in any extended position relative to the upright frame member 13, for instance, and the platform 12 is adjustable to the dot-dash lines shown on the right in FIG. 1. In either the retracted platform position shown in full lines or the extended platform position shown in dot-dash lines, the platform 12 is directly above the T-shaped frame and particularly above the frame member 19 and does not extend beyond the frame member end 24, and thus the entire support is stable and will not tip even though the mechanic is resting on the support by standing on the platform 11 and lying on the upper platform 12. Further, the platform frame member 26 includes the upright section 26 and the angled section 27 and the substantially horizontally extending section 28 which actually extends slightly upward at an angle as shown in FIG. 1. The section 27 is a length of a straight section, rather than a curved section, and it therefore clearly provides a space designated S immediately above the straight-length section 27 and therefore the mechanic's intermediate or central portion of his total height will find clearance when he is standing on the platform 11 and has his chest on the pad 18, and this is deemed to be important when considering that the mechanic is in the standing and forward or prone position with his chest on the pad 18.

In the use of the support as described to this point, it will now be seen and understood that the mechanic supports his weight on his feet on the platform 11 and by his back, and also by his chest resting on the pad 18. This is a comfortable position which will permit him to remain in this position for extended lengths of time, as required.

The frame members shown and described are rectangular tubular members, as shown by the dotted lines on the interior of any and all of those rectangular tubular members, and thus they remain in the desired alignment and will not be turned sidewise and thereby unbalance the support. Further, the telescoping and sliding relationship between the members is achieved by the rectangular tubular relationship shown and described herein.

The upright frame piece 13 is secured to the T-shaped frame 10 adjacent the juncture where the weld 22 is located, and thus there is stability in that regard and when the mechanic is standing on the platform 11 which is shown to surround the upright frame piece 13. The platform 11 extends to the length of the frame piece 21, and it is upwardly adjustable by sliding on the frame piece 13 through the means of a tubular collar 29 welded with the platform 11 at 31, for instance. Thus, the collar 29 can be slid up and down on the upright standard or frame piece 13 and therefore the platform 11 will be moved up and down as desired by the mechanic's position or by the mechanic's height. A screw 32 is shown on the collar 29 and it can extend to the frame piece 13 for securing the collar 29 in any raised elevated position along the frame piece 13 whose upper end is shown at 33.

It will now also be seen and understood that the frame piece 13 is of a rectangular tube and therefore has a hollow interior which receives the platform portion 26 slidable therein and thus permitting the vertical adjustment for the entire platform 12. That is, the platform piece 16 slides up and down in the frame piece 13 for vertical adjustment of the platform 12, and a screw 34 is affixed to the frame piece 13 for securing the platform piece 16 in a vertically adjusted position. As indicated, the piece 16 is of a rectangular tubular configuration, and also the piece 17 is of that configuration, and therefore the pieces 16 and 17 retain their desired alignment extending directly over the frame piece 19 and in the vertical plane of the piece 19 and also the platform 12 extends in that vertical plane as clearly seen in FIG. 2 where the platform 12 is shown to be symmetrical with the vertical plane of the long axis of the frame piece 19.

Therefore, the rectangular sleeve 17 will slide on the rectangular support member 16 for the substantially horizontal adjustment of the platform 12, and the platform 12 will not tip since the sleeve 17 is always in alignment with the rectangular piece 16 and is secured to the platform base pieces 36 and 37, such as by means of the welding at 38 with the piece 36, and the piece 37 and the pad 18 can be suitably connected with the rectangular plate 36, for instance. A stop 39 is affixed to the end of the length 28 of the piece 16 to prevent the sleeve 17 from sliding beyond the piece 16. Also, a tool and parts container or box 41 is suitably affixed to the platform 12 and is available for receiving tools and parts for the convenience of the mechanic, and of course the box 41 is shown to have clearance with the frame members and with the piece 16 in all positions for the platform 12.

Therefore, the frame 10 consists of the stem piece 19 and the cross bar piece 21 and there is the additional and upstanding frame piece 13.

The mechanic can utilize the support by standing on the platform 11 with his feet on opposite sides of the upright frame piece 13, and he can still lean forwardly onto the platform 12 and find clearance for his body, by virtue of the angled length 27. In that arrangement, he can stand virtually to the side of the wheel W and thereby be in the optimum position with respect to accessibility of any and all parts in the engine compartment, since the wheel W is substantially on the center plane of the engine compartment. With appropriate adjustments of the two adjustable platforms 11 and 12, and the adjustments being either for the size of the mechanic or for the location of the work in the engine compartment, the mechanic can distribute his own body weight on both the platform 11 and the platform 12 rather than on only one support platform or the like.

What is claimed is:

1. An automobile mechanic's body support comprising a horizontally disposed T-shaped mobile frame, an additional frame member connected to said T-shaped frame at the juncture of the stem and cross bar of said T-shaped frame and extending upwardly therefrom, a standing platform supported on said frame members and extending to opposite sides of said additional frame member for the standing support of the automobile mechanic, and an additional platform supported on said frame members and extending at least substantially horizontally and spaced directly above and symmetrical with the vertical plane of the length of the stem of said T-shaped frame for the prone support of the torso of the automobile mechanic.

2. The automobile mechanic's body support as claimed in claim 1, including adjustable slidably related members interconnected between said frame members and said additional platform for adjustable positioning of said additional platform in the horizontal direction along the vertical plane through said additional frame member.

3. The automobile mechanic's body support as claimed in claim 1 or 2, wherein said slidable members include a rectangular tube and a rectangular sleeve slidably related.

4. The automobile mechanic's body support as claimed in claim 1 or 2, wherein said frame members are rectangular tubes, and said additional frame members and said additional platform have interconnected rectangular tubes extending in the upward direction for vertical adjustment of said additional platform.

5. The automobile mechanic's body support as claimed in claim 1 or 2, wherein said additional frame member and said standing platform include adjustable slidably related members for vertical adjustment of said standing platform.

6. The automobile mechanic's body support as claimed in claim 4, wherein said additional frame member and said standing platform include adjustable slidably related members for vertical adjustment of said standing platform.

7. The automobile mechanic's body support as claimed in claim 1 or 2, wherein said additional platform includes a rectangular tube and said additional frame member is a rectangular tube adjustably slidably nested with said additional platform rectangular tube, and said additional platform rectangular tube including a length extending angled away from the longitudinal axis of said additional frame member rectangular tube and to a location immediately beneath said additional platform, for clearance with the intermediate height of the automobile mechanic when in the prone on said additional platform.

8. The automobile mechanic's body support as claimed in claim 1 or 2, including a wheel mounted on each of the three terminal ends of said T-shaped frame.

9. The automobile mechanic's body support as claimed in claim 2, including an item container connected to said additional platform for holding tools and parts; said container being located spaced from said frame members for clearance movement with the movement of said additional platform.

10. An automobile mechanic's body support comprising a horizontally disposed T-shaped mobile frame, a first upright rectangular tube member connected to said frame adjacent the juncture of the T-shape and extending thereabove and being on the vertical plane extending through the length of the stem of the T-shape, a foot platform supported on said frame, a second rectangular tube member slidably telescoped into the upper end of said first tube member and extending thereabove, and having an upper length extending horizontally along said vertical plane and terminating short of the vertical plane passing through the free end of the stem of the T-shape, a rectangularly-shaped sleeve slidably telescoped on said upper length for movement in the horizontal direction, a chest-rest platform connected to said sleeve and extending horizontally above said sleeve for supporting the torso of the automobile mechanic in selected positions along said upper length, and a lock interconnected between said upright tube members for adjustably securing said upright tube members in vertically adjusted positions.

* * * * *